US012509944B2

(12) United States Patent
Boswell

(10) Patent No.: US 12,509,944 B2
(45) Date of Patent: Dec. 30, 2025

(54) RETURN EXHAUST ASSEMBLY FOR A REVERSE CIRCULATION HAMMER

(71) Applicant: Ignis Technologies Pty Ltd, Bellevue (AU)

(72) Inventor: Peter Warwick Boswell, Hovea (AU)

(73) Assignee: Ignis Technologies Pty Ltd., Bellevue (AU)

( * ) Notice: Subject to any disclaimer, the term of this patent is extended or adjusted under 35 U.S.C. 154(b) by 0 days.

(21) Appl. No.: 18/761,294

(22) Filed: Jul. 1, 2024

(65) Prior Publication Data

US 2024/0352796 A1 Oct. 24, 2024

Related U.S. Application Data

(63) Continuation of application No. 17/597,543, filed as application No. PCT/AU2020/050726 on Jul. 13, 2020, now Pat. No. 12,055,016.

(30) Foreign Application Priority Data

Jul. 11, 2019 (AU) ..... 2019902457

(51) Int. Cl.
*E21B 4/14* (2006.01)
*E21B 21/10* (2006.01)

(52) U.S. Cl.
CPC ..... *E21B 4/14* (2013.01); *E21B 21/103* (2013.01)

(58) Field of Classification Search
CPC ..... E21B 4/14; E21B 21/103; E21B 21/08; E21B 17/03; E21B 17/04; E21B 17/14;
(Continued)

(56) References Cited

U.S. PATENT DOCUMENTS 4,921,052 A 5/1990 Rear
5,975,222 A 11/1999 Holte
(Continued)

FOREIGN PATENT DOCUMENTS

GB 2296731 7/1996
GB 2296731 A * 7/1996 ..... E21B 21/12
WO 2010/060134 6/2010

OTHER PUBLICATIONS

International Search Report and Written Opinion (Application No. PCT/AU2020/050726), dated Sep. 21, 2020.
(Continued)

*Primary Examiner* — Steven A Macdonald
(74) *Attorney, Agent, or Firm* — Brown & Brown IP Law PLLC

(57) ABSTRACT

A return exhaust assembly 50 for a reverse circulation hammer H comprises return tube 52 having first and second ends and a seat 56 at or near the first end 54. An exhaust sleeve 58 has: a section 60 seated and resiliently supported on the seat 56; and, a portion 62 that extends to and includes an end 64 of the exhaust sleeve 58 distal the section 60. The portion 60 surrounds a length of the return tube 52 with an annular clearance 66 formed between the return tube 52 and the sleeve 58 from a down hole end of the seat 56 to the distal end 64 of the exhaust sleeve 58. This arrangement allows relative movement, and therefore a degree of misalignment between the exhaust sleeve 58 and the return tube.

20 Claims, 6 Drawing Sheets

(58) Field of Classification Search
CPC ..... E21B 17/18; E21B 21/12; E21B 21/14; E21B 2200/02
See application file for complete search history.

(56) References Cited

U.S. PATENT DOCUMENTS

| | | | | |
|---|---|---|---|---|
| 6,386,301 | B1 * | 5/2002 | Rear | E21B 4/14 175/321 |
| 10,323,457 | B2 * | 6/2019 | Boswell | E21B 21/10 |
| 2004/0245020 | A1 * | 12/2004 | Giroux | E21B 7/06 175/171 |
| 2008/0029307 | A1 * | 2/2008 | Green | E21B 17/1092 175/296 |
| 2013/0233626 | A1 * | 9/2013 | Aros | E21B 4/14 175/296 |
| 2017/0152711 | A1 * | 6/2017 | Boswell | E21B 4/14 |
| 2017/0241213 | A1 | 8/2017 | Boswell | |
| 2022/0349255 | A1 | 11/2022 | Boswell | |

OTHER PUBLICATIONS

International Preliminary Report on Patentability (Chapter II)(Application No. PCT/AU2020/050726, dated Jun. 21, 2021.

* cited by examiner

RETURN EXHAUST ASSEMBLY FOR A REVERSE CIRCULATION HAMMER

CROSS-REFERENCE TO RELATED APPLICATION

This application is a continuation of U.S. patent application Ser. No. 17/597,543, filed Jan. 11, 2022, the entirety of which is incorporated herein by reference.

TECHNICAL FIELD

A return exhaust assembly is disclosed for a reverse circulation (RC) hammer.

BACKGROUND ART

A reverse circulation (RC) hammer is used for drilling holes in the ground. The hammer comprises, amongst other components, a drill bit, a piston and an inner tube. A compressed or pressurised fluid such as air or water may be used to reciprocate the piston along the inner tube to cyclically strike the drill bit. The percussion of the piston on the drill bit is transferred to the ground causing fragmentation of rock. The fluid used for driving the piston flows back up the inner tube to the surface carrying drill cuttings from the toe of the hole. In this way the RC hammer can provide continuous sample collection in a fraction of the time of a diamond or core drill.

The above described background art is not intended to limit the application of the return exhaust assembly as disclosed herein.

SUMMARY OF THE DISCLOSURE

In broad and general terms, a return exhaust assembly is disclosed that includes a return tube and an exhaust sleeve, the return tube seated in a manner that allows a degree of axial misalignment during operation of a reverse circulation hammer incorporating the return exhaust assembly. The term axial misalignment is intended to mean that the respective axes of the return tube and the exhausts are not aligned in the sense that they are non-parallel. In effect there is a resilient or floating coupling between the exhaust sleeve and the return tube. This design removes the need for precision alignment of the return tube and allows it to float between bearing surfaces in the bit of the RC hammer and its bearing in the internal surfaces of the exhaust sleeve. In the absence of this, precision alignment is required to avoid heat checking of the reciprocating piston which rapidly leads to fracturing of the piston and failure of the hammer.

The ability to accommodate this misalignment is facilitated by the provision of an annular gap or passage between the inner tube and the exhaust sleeve of the return exhaust assembly. The annular gap or passage forms a fluid bypass enabling an operator to vary or control the amount of fluid otherwise used for driving a piston of the RC hammer to bypass the piston and thus reduce the striking force of the piston on the hammer bit. The bypass flow is delivered into the hole being drilled and is used to assist in carrying drill cuttings back through ports in the hammer bit and the inside of the inner tube to the surface. The proportion of fluid is split between driving the piston and flowing through the bypass can be varied depending on ground conditions. For example, if drilling in clays it may be preferable to reduce the impact force on the hammer bit and increase the flow to the bypass to minimise the risk of clogging the return system of the hammer.

In a first aspect there is disclosed a return exhaust assembly for a reverse circulation hammer comprising:

- a return tube having first and second ends and a seat at or near the first end;
- an exhaust sleeve having a section seated and resiliently supported on the seat and a portion that extends to and includes a downhole end of the exhaust sleeve distal the section, wherein the portion surrounds a length of the return tube with an annular clearance formed between the return tube and the exhaust sleeve from the seat to the downhole end of the exhaust sleeve.

In a second aspect there is disclosed a return exhaust assembly for a reverse circulation hammer comprising:

- a return tube having first and second ends and a seat at or near the first end;
- an exhaust sleeve having an up hole end and a downhole end, the exhaust sleeve located about the return tube with an inner circumferential surface of a section of the exhaust sleeve being radially adjacent the seat, the exhaust sleeve having a portion that extends to the downhole end of the exhaust sleeve;
- wherein the up hole and downhole ends of the exhaust sleeve are located inboard of the first and second ends of the return tube, and an annular clearance is formed between the return tube and the sleeve from the seat to the downhole end of the exhaust sleeve.

In one embodiment return exhaust assembly comprises one or more resilient elements located between the seat and the section, one or more resilient elements forming a fluid seat to prevent flow of fluid across the seat.

In one embodiment the return tube, the exhaust sleeve, the annular clearance and the one or more resilient elements enables a degree of axial misalignment between the return tube in the sleeve.

In one embodiment the section and the seat are relatively dimensioned so that the section of the exhaust sleeve overlies the seat for less than 50% of an overall length of the exhaust sleeve.

In one embodiment the section and the seat are relatively dimensioned so that the section of the exhaust sleeve overlies the seat for less than 20% of an overall length of the exhaust sleeve.

In one embodiment the seat has a first outer diameter and the length of the return tube has a second outer diameter less than the first outer diameter.

In one embodiment the seat is formed inboard of the first end of the return tube, and a shoulder is formed between the seat and the first end of the return tube and wherein the shoulder forms an abutment for axial displacement of the exhaust sleeve relative to the return tube in a direction toward the first end of the return tube.

In one embodiment the section has an outer diameter that extends radially beyond the shoulder.

In one embodiment the exhaust sleeve comprises one or more ports enabling fluid communication between a region on a side of an outer circumferential surface of the exhaust sleeve and the annular clearance.

In one embodiment the return exhaust assembly comprises a choke ring having a fluid flow manifold enabling fluid flow between an inner circumferential wall and an outer surface of the choke rig, the choke ring being locatable over the section of the exhaust sleeve in a: first orientation in which the manifold registers with the ports to allow of the fluid communication; and, a second orientation in which choke ring covers the ports to block the fluid communication.

In one embodiment the downhole end of the exhaust sleeve is provided with a progressively decreasing outer diameter.

In one embodiment the exhaust sleeve comprises one or more spaced apart annular grooves formed in the inner circumferential surface of the section of the exhaust sleeve.

In one embodiment the return exhaust assembly further comprises:

a second tube made of material having a higher wear resistance than material from which the return tube is made, the second tube coupled to the return tube at the second end, wherein an inner circumferential surface of the second tube forms a contact surface for material flowing in a direction from the second end toward the first end.

In one embodiment the second tube is configured to form either (a) an initial annular contact surface for the material flowing in the direction, (b) an initial inner circumferential contact surface for the material flowing in the direction; or (c) and initial annular and an initial inner circumferential contact surface for the material flowing in the direction.

In one embodiment the second tube comprises a circumferential lip that forms the annular contact surface for the material flowing in the direction.

In one embodiment the sample tube has an inner circumferential surface of diameter D1 at a location adjacent an up hole end of the second tube, and the second tube has an inner circumferential surface with a diameter D3 wherein D3≤D1.

In one embodiment D3<D1 and there is a stepped transition between D1 and D3 at the location adjacent the up hole end of the second tube.

In one embodiment the second tube includes a portion located inside of the return tube.

In a third aspect there is disclosed a reverse circulation hammer comprising:

a hammer bit;

a piston;

a return exhaust assembly according to the first or second aspect wherein the return tube passes through the piston and the second end of the return tube is located within the hammer bit and the exhaust sleeve extends into the piston at least when the piston is at a top of its stroke; and a bypass inlet formed between the return tube and the exhaust sleeve up stream of the piston, the bypass inlet providing fluid communication between a source of driving fluid for the reverse circulation hammer and the annular clearance, the annular clearance forming a bypass path arranged to bypass a portion of the driving fluid from driving the piston and toward an outlet downstream of the piston wherein the bypass portion of the driving fluid flows into a hole being formed by operation of the reverse circulation hammer.

In one embodiment the reverse circulation hammer comprises:

a bypass inlet formed between the return tube and the exhaust sleeve up stream of the piston, the bypass inlet providing fluid communication between a source of driving fluid for the reverse circulation hammer and the annular clearance, the annular clearance forming a bypass path arranged to bypass a portion of the driving fluid from driving the piston and toward an outlet downstream of the piston wherein the bypass portion of the driving fluid flows into a hole being formed by operation of the reverse circulation hammer.

In one embodiment the reverse circulation hammer comprises an adjustment mechanism operatively associated with the bypass inlet to enable a user to vary a ratio of flow of the driving fluid provided to drive the piston and the flow of the driving fluid entering the bypass inlet.

In a fourth aspect there is disclosed a return tube for a reverse circulation hammer comprising a first tube having first and second opposite ends wherein when installed in a reverse circulation hammer the second end is located down hole of the first end; a downhole section made of material having a higher wear resistance than material from which a remainder first tube is made, the downhole section forming an initial inner contact surface of the return tube for material flowing in a direction from the second end toward the first end.

In a fifth aspect there is disclosed a return tube for a reverse circulation hammer comprising:

a first tube having first and second opposite ends wherein when installed in a reverse circulation hammer the second end is located down hole of the first end;

a second tube made of material having a higher wear resistance than material from which the first tube is made, the second tube coupled to the first tube at the second end, an inner circumferential surface of the second tube forming an initial inner contact surface of the return tube for material flowing in a direction from the second end toward the first end.

In one embodiment the second tube is configured to form either: (a) an initial annular contact surface for the material flowing in the direction; (b) an initial inner circumferential contact surface for the material flowing in the direction; or, (c) and initial annular and an initial inner circumferential contact surface for the material flowing in the direction.

In one embodiment the second tube comprises a circumferential lip that forms the annular contact surface for the material flowing in the direction.

In one embodiment the sample tube has an inner circumferential surface of diameter D1 at a location adjacent an up hole end of the second tube, and the second tube has an inner circumferential surface with a diameter D3 wherein D3≤D1.

In one embodiment D3<D1 and there is a stepped transition between D1 and D3 at location where the second tube is coupled to the return tube.

In one embodiment the second tube includes a portion located inside of the first tube.

In one embodiment the first tube is formed with an increased inner diameter portion leading to the second end forming a circumferential seat for the second tube.

In one embodiment the increased inner diameter portion is one of two or more successive portions of the first tube wherein the inner diameter of successive portions in a direction toward the second end have increased inner diameters.

BRIEF DESCRIPTION OF THE DRAWINGS

Notwithstanding any other forms which may fall within the scope of the return exhaust assembly as set forth in the Summary, specific embodiments will now be described, by way of example only, with reference to the accompanying drawings in which.

DESCRIPTION OF SPECIFIC EMBODIMENTS

Figure 1:
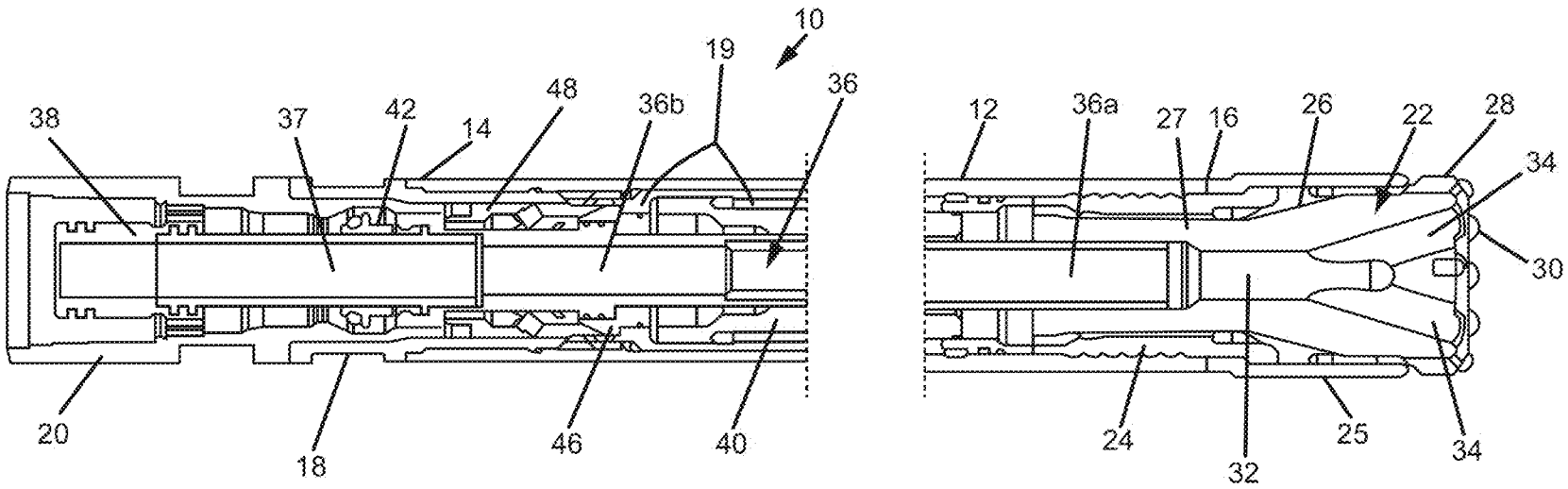
FIG. 1 a cross-section view of a prior art reverse circulation hammer.

To provide context for the description of the specific embodiments, a description of the main features and operation of a prior art reverse circulation (RC) hammer is provided with reference to FIG. 1 which shows in longitudinal section a prior art RC hammer 10.

The hammer 10 has an outer case 12 with an up hole or upstream end 14 and a down hole or downstream end 16. A porting sleeve 18 is connected to the up hole end 14 of the case 12 and a sub 20 is connected between the porting sleeve and a drill string (not shown). A downhole portion 19 of the porting sleeve 18 directs the hammer driving (or working) fluid to the working chambers of the hammer. The driving fluid may be a compressed gas such as air or a pressurised liquid such as water or mud. A hammer bit 22 is slidably coupled to the downhole end 16 of the case 12 by a drive sub 24. A shroud 25 surrounds an outer circumferential surface of a head 26 of the bit 22 and is coupled to the outer case 12 by the drive sub 24. The bit 22 has a crown 28 that sits outside of the shroud 25 and is formed with a cutting face 30. A central passage 32 is formed in a shank 27 of the bit 22 and splits into a number of diagonal channels 34 that lead to the bit face 30.

An inner tube assembly 36 extends through the case 12 and has one end residing within the central passage 32 of the bit 22 and an opposite end coupled to a short sample tube 37. The short tube 37 is connected to an adapter nozzle 38 which is held in the sub 20. The inner tube assembly 36 comprises tubes 36*a* and 36*b* which are rigidly connected in an end to end manner to maintain a coaxial relationship with each other.

A piston 40 can reciprocate within the case 12 by action of the driving fluid to cyclically impact the bit 22. The piston 40 is coaxial with, and reciprocates relative to, the inner tube assembly 36. A check valve 42 is positioned within the coupling sleeve 18 upstream of the piston 40. The downhole portion 19 of the porting sleeve 18 extends between the piston 40 and an inner circumferential surface of the case 12. The porting sleeve 18 directs the driving fluid to flow between the inner surface of the case 12 and the exterior surface of the piston 40.

An inner tube bearing seat 46 surrounds and forms a bearing surface for a portion of the return exhaust assembly 36, assisting to maintain the inner tube 36 coaxial with the case 12. The bearing seat 46 also provides a bearing surface for one end of the porting sleeve 18. A second housing 48 is provided within the casing 12 that, together with the porting sleeve 18 acts as a second bearing for the inner tube 36. Thus, the inner tube 36 is rigidly held coaxially within the hammer at two spaced apart locations. The downhole end of the inner tube 36 is retained within the passage 32 of the bit 22.

When the hammer 10 is in use the driving fluid is delivered through the drill string attached to the sub 20 and is directed to flow between the adapter nozzle 38 and the inner surface of the sub 20 and open the check valve 42. With the check valve 42 open the fluid then reaches the porting sleeve 18 and is directed to flow between the outside of the down hole portion 19 porting sleeve 18 and inside surface of the case 12. Due to the configuration of the outer surface of the piston 40, and the shaping of the interior surface of the case 12 the flow of fluid reciprocates the piston 40 to cyclically impact the upper end of the bit 22. The impact forces are transmitted through to the bit face 30 to fracture underlying strata.

The fluid used to drive the piston 40 exits between the shroud 25 and the head 26, flows about the crown 28 and back up the channels 34 and 32 through the inner tube assembly 36 and to the surface carrying with it drill cuttings formed by the impact of the bit 22. These cuttings can then be assayed to determine the mineralogy of the ground.

Figure 2:
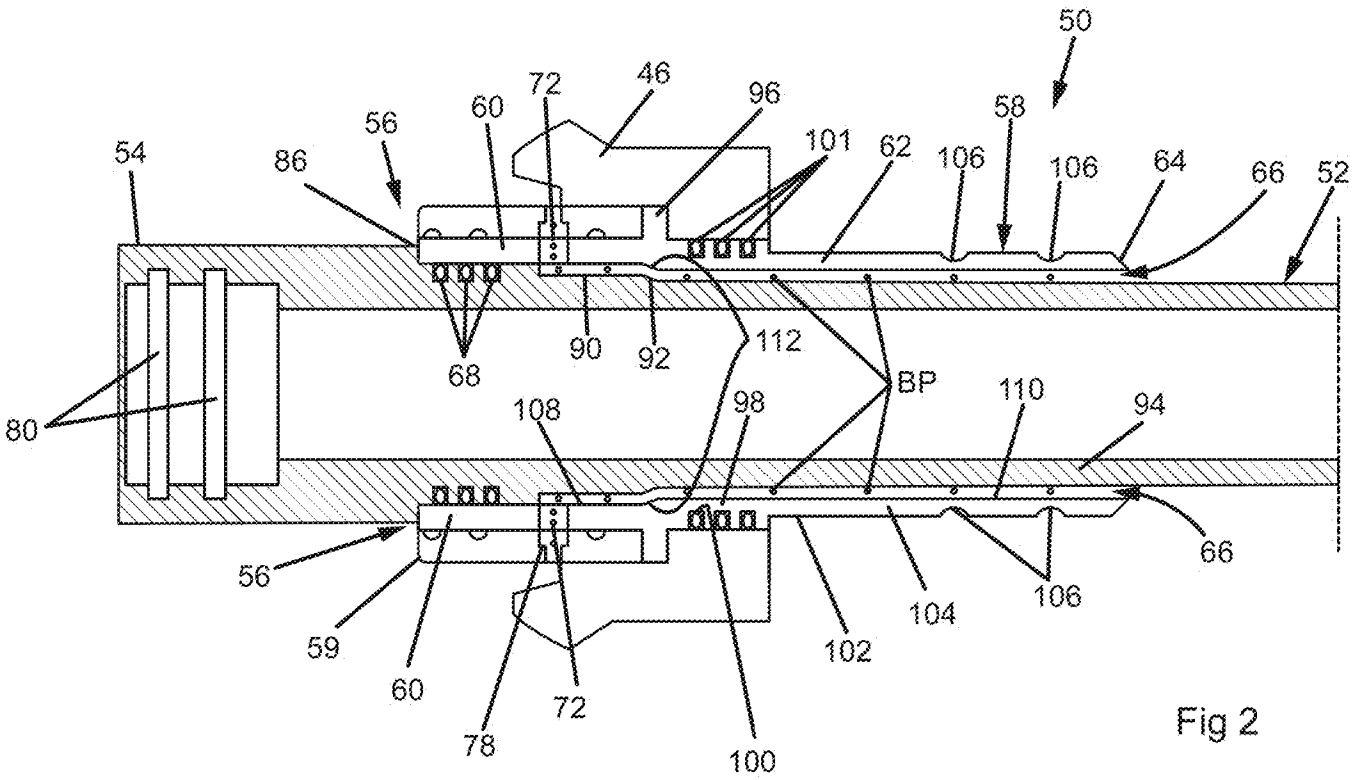
FIG. 2 is a cross-section view of an embodiment of the disclosed return exhaust assembly.
Figure 3:
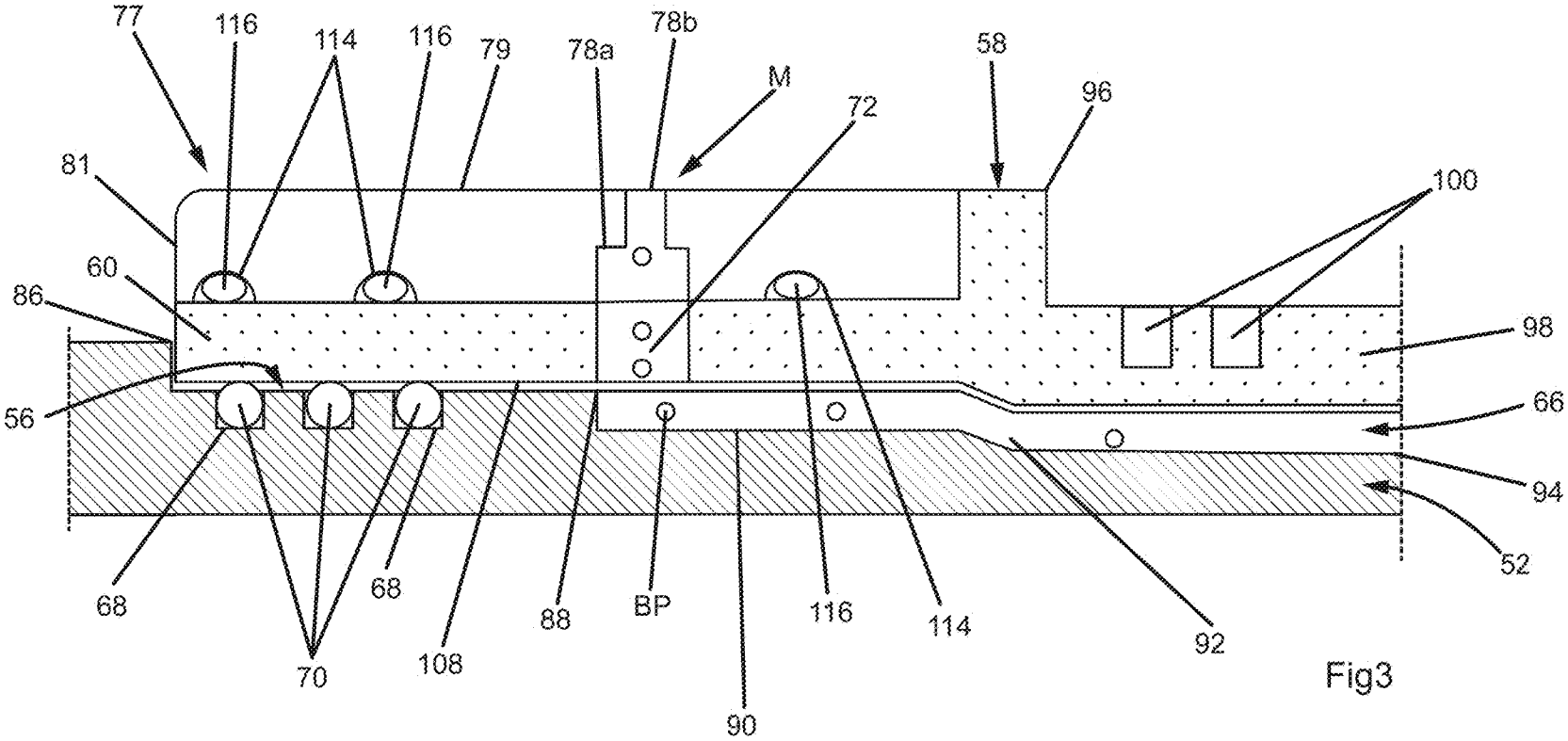
FIG. 3 is an enlarged view of a portion of the return exhaust assembly shown in FIG. 2.

An embodiment of the disclosed return exhaust assembly 50 for a reverse circulation hammer H will now be described with reference to FIGS. 2-4.

The return exhaust assembly 50 comprises a return tube 52 having a first end 54 and a seat 56 at or near the first end 54. The first end 54 is an upstream or up hole end of the return tube 52. The return tube 52 also has a downhole or second end which constitutes the down hole or downstream end of the return tube 52. While this downhole end is not shown in FIG. 2 or 3 it would reside within the central passage the hammer bit when the assembly 50 is installed within a hammer, in a manner similar to that shown in FIG. 1. The return exhaust assembly 50 is used in a RC hammer in place of the prior art inner tube assembly 36. Thus, if the assembly 50 were installed in the prior art hammer 10 shown in FIG. 1 in place of the inner tube assembly 36, the downhole end of the return exhaust assembly 50 would reside within the passage 32 of the bit 22, and the up hole end 54 would be received within the short tube 37.

The return exhaust assembly 50 also has an exhaust sleeve 58 with an up hole end 59 and a downhole end 64. The exhaust sleeve 58 has a section 60 at the up hole end 59 that is seated and resiliently supported on the seat 56, and a contiguous portion 62 that extends to the downhole end 64 of the exhaust sleeve. An annular clearance or passage 66 is formed between the return tube 52 and the exhaust sleeve 58 from the seat 56 to the distal end 64 of the exhaust sleeve 58.

The seat 56 includes at least one and in this, but not necessarily all embodiments, three grooves 68 for seating resilient elements in the form of rubber O-rings 70. The O-rings 70 are compressed between the seat 56 and the portion 60 of the exhaust sleeve 58 and form a fluid seal to prevent a flow of fluid across the seat 56 (i.e. between the seat 56 and the inner circumferential surface of the section 60. There is however some clearance between the seat 56 and the section 60 to enable fitting of the sleeve 58 onto the seat 56. As seen in FIG. 4 the bearing seat 46 (which does not form part of the disclosed return exhaust assembly 50) acts as a bearing seeking to hold the sleeve 58 coaxially with the porting sleeve 18.

In the absence of any difference in force acting transversely on the return tube 52 and the exhaust sleeve 58, the return tube 52 and the exhaust sleeve 58 are held substantially coaxially with each other. However, the annular clearance 66 and the resilient support of the section 60 on the seat 56 provided by the O-rings 70 enables a degree of axial misalignment between the return tube 52 and the sleeve 58 so that they are no longer coaxial. The degree of misalignment is such that the distal end 64 can be displaced toward (and optionally not contact) the return tube 52. In one embodiment the section 60 and the seat 56 may be relatively dimensioned so that the section 60 overlies the seat 56 for less than 50% of an overall length of the exhaust sleeve; or less than 20% of the overall length of the exhaust sleeve.

As a point of distinction with the prior art two piece inner tube 36 shown in FIG. 1 in the return exhaust assembly 50 the up hole and downhole ends of the return tube 52 form the up hole and downhole ends of the assembly 50, so that it is the up hole end 54 of the return tube 52 that receives the short tube 37. The exhaust sleeve 58 is located about the return tube 52, with its up hole and downhole ends 59, 64 located inboard of the up hole and downhole ends of the return tube 52. That is, the return tube 52: (a) passes through exhaust sleeve 58 and (b) extends beyond the up hole and the downhole ends 59, 64 of the exhaust sleeve 58. While the inner tube 36 of the prior art hammer 10 is also formed of two tubes 36*a* and 36*b*, these tubes are connected together end to end. As a consequence of this construction of the assembly 50 although the exhaust sleeve 58 (equivalent to the tube 36*b* of the prior art) is concentrically and rigidly held by the bearing seat 46, the return tube 52 (equivalent to the tube 36*a* in the prior art) passes wholly through the exhaust sleeve 58.

In a conventional prior art reverse circulation hammer shown in FIG. 1 the inner tube assembly 36 is generally supported on two spaced apart bearing surfaces. The purpose of this is to hold the inner tube rigidly and coaxially with the outer case 12 and the piston 40 so that ideally there is no interference between the piston and the inner tube which may cause heat checking and subsequent cracking and ultimately breaking of the piston. Embodiments of the disclosed return exhaust assembly 50 specifically allow for the return tube 52 to be misaligned with the axis of the case 12 while enabling the exhaust sleeve 58 to be held in a coaxial relationship with the piston 40 to avoid contact therebetween and least allow a degree of movement or wobble of the return tube 52 relative to exhaust sleeve 58 as the piston slides over it; both of which minimise the risk of sliding interference and heat checking. The maximum degree of misalignment between the tube 52 and the sleeve 58 that is possible is limited by the end 64 of the exhaust sleeve 58 contacting the return tube 52. However, by appropriate dimensioning of the length of the seat 56 and section 60 it is possible to limit the degree of misalignment to prevent contact between the sleeve end 64 and the return tube 52, if desired.

The sleeve 58 is formed with a plurality of ports 72 that enable fluid communication between a region 74 on a side of an outer circumferential surface of the exhaust sleeve 58 and the annular passage 66. This enables a portion of the fluid used to drive the hammer to bypass the piston 40. This portion of fluid (which is represented by dots BP in FIGS. 2-4) flows through the passage 66 and subsequently between the return tube 52 and the inner circumferential surface of the piston 40. The bypass fluid BP is channeled to flow between the outside of the shank 27 and the shroud 25 and into a hole being formed by the hammer H. This fluid is then able to flow back up the passages 34 and 32 and through the return exhaust assembly 50 to the surface. The remainder of the fluid, which typically would be the greater proportion, flows between the porting sleeve portion 19 and the inside surface of the case 12. This fluid is subsequently directed to flow between the outer surface of the piston 40 and the inside of the case 12 to cause reciprocation of the piston 40 and cyclical impacts on the bit 22. It is this portion of the fluid that determines the power of the hammer H.

The proportion of the driving fluid that is split between powering the piston 40 and the bypass BP can be controlled by a choke ring 77 which is placed about the section 60 of the exhaust sleeve 58. The choke ring 77 is provided a fluid flow manifold M that allows fluid to flow between the inner circumferential surface of the ring 77, and an outer surface of the choke ring 77. The outer surface may be for example the outer circumferential surface 79 (as in the illustrated embodiment), or a rear radial surface 81, of the choke ring 77, or indeed a combination of both. The manifold M can register with the ports 72 in the exhaust sleeve 58. By varying the dimensions and/or design of the manifold M the volume and flow rate of fluid through to the ports 72 can be controlled.

In this embodiment the manifold comprises a circumferential groove 78*a* formed on the inner circumferential wall of the choke ring 77 and one or more holes 78*b* that open onto the groove 78*a* and the outer circumferential surface of the choke ring 77.

The groove 78*a* is positioned so that in one orientation of the choke ring on the exhaust sleeve 58, the groove 78*a* overlies the holes 72. The holes 78*b* can be made of a smaller minimum diameter than the holes 72 thereby reducing the amount of fluid that can bypass the piston 40. A hammer operator can be provided with a plurality of choke rings 77 each with holes 78*b* of a different minimum diameter; or a different number of holes 78*b*. It is also possible to close off the holes 72, thus have no bypass flow for full hammer power by either having a choke ring with no holes at all, or simply reversing the orientation of the choke ring 77 so a portion without the manifold M (and thus the groove 78*a*) overlies the holes 72. The hammer operator can then use whichever choke ring 77 (or ring orientation) is deemed to be the most suitable to provide the required split between piston power and bit face fluid flow.

Prior art RC hammer designs without a variable bypass, such as that provided by the interaction between the choke ring 77 and holes 72 in the exhaust sleeve 58, can only operate in clay (plastic material) with a maximum amount of air supplied to the piston (work chamber).

When this limit is exceeded the hammer will not reliably operate because of bit-face plugging and will frequently stop. To fix this the hammer and associate drill string will need to be pulled from the drill hole to have plugged ports manually cleared. This will reduce productivity.

There are competing issues that need to be balanced. Sufficient bit-face airflow needs to be maintained to force the sample return through the bit-face return holes, and inner-tube system, to the surface. But if this condition is satisfied, the hammer will usually produce excessive energy which will promote bit-face plugging, which would interrupt the drilling.

In embodiments in which the choke ring 72 and exhaust sleeve 56 are incorporated the above problem may be alleviated by producing two separate airstreams: flow adjustable against each other. This means that air can routed more directly to the bit-face to maintain pressure and velocity to keep the return system clean without needing to route the total air supply through the work chamber of the hammer where it would cause bit-face plugging as in all prior art systems.

Embodiments of the disclosed return exhaust assembly 50 enable higher total airflow (which is required to keep the sample return system clear) and lower percussive energy which assists to reduce bit-face plugging and maintain reliable production.

Figure 4:
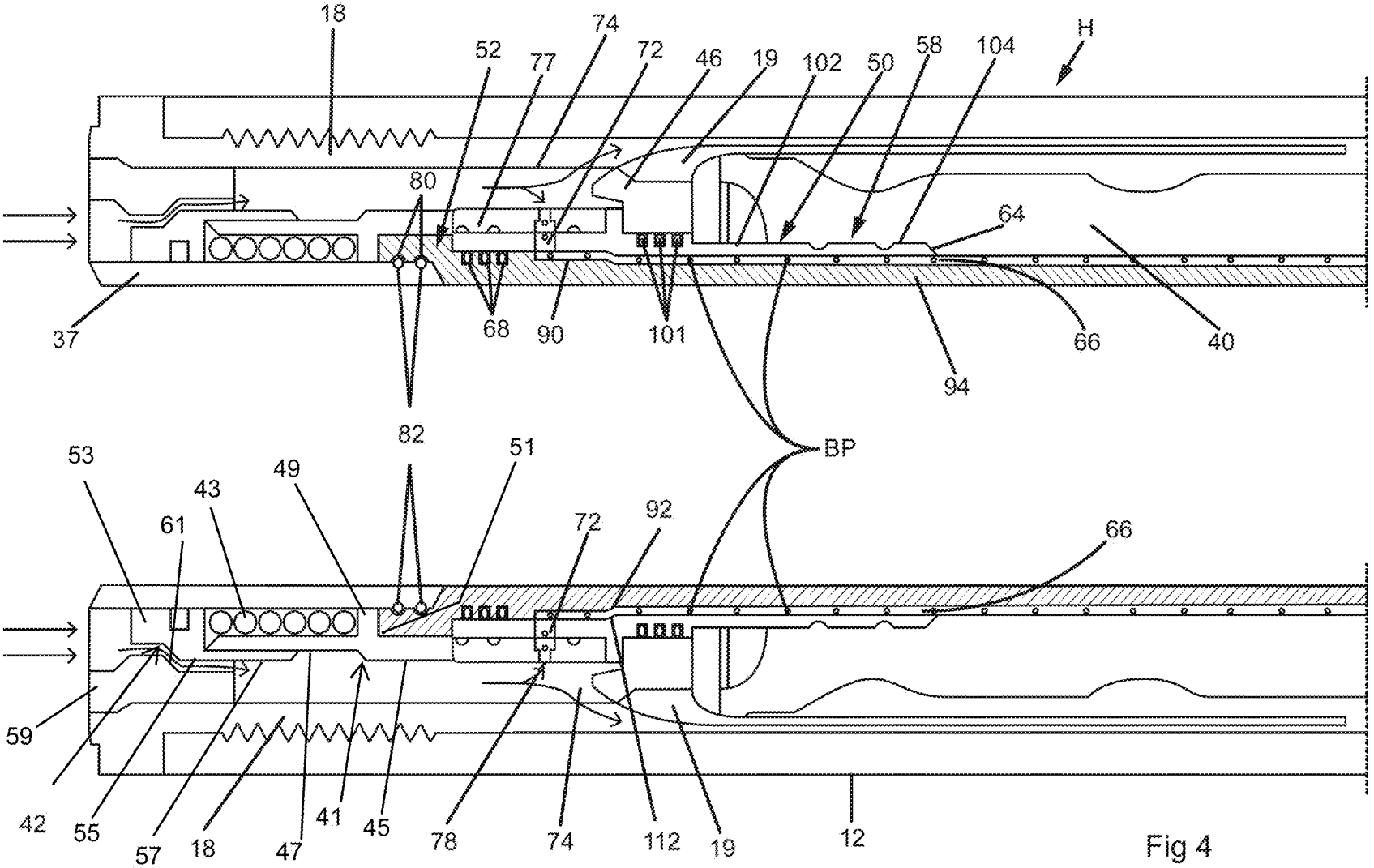
FIG. 4 is a cross-section view of a portion of a reverse circulation hammer incorporating an embodiment of the disclosed return exhaust assembly.

Looking at the geometry of the return exhaust assembly 50 components more closely, starting from the up hole end 54, the return tube 52 is formed with two (though in other embodiments there may be one, three or more) internal grooves 80 for receiving O-rings 82 (seen in FIG. 4). The up hole end 54 is fitted onto the short tube 37 which in turn is coupled with an internal conduit (not shown) of the drill string to enable cuttings to flow to the surface. The O-rings 82 form a seal between the return tube 52 and the short tube 37. An outer surface of the return tube 52 is provided with a shoulder 86 forming a stepped reduction in outer diameter at an up hole end of the seat 56. This leads to the seat 56 which is formed with the grooves 68 that seat the O-rings 70. At the end of the seat 56 is a further shoulder 88 providing a stepped reduction in the outer diameter and leading to a section 90 of constant inner diameter. Moving in a downhole direction this is followed by a section 92 of progressively decreasing inner diameter forming a sloped surface which leads to a remaining length 94 of the inner tube having a constant inner diameter.

The exhaust sleeve 58 after the section 60 moving in a downhole direction is formed with a circumferential flange 96 followed by a portion 98 of reduced but constant outer diameter and in which is formed a plurality of circumferential grooves 100. The grooves 100 seat respective O-rings 101 that assist in forming a seal between the exhaust sleeve 58 and the bearing seat 46. This is followed by a portion 102 that tapers to a tail section 104 of constant outer diameter and terminates in the distal end 64. The distal end 64 has a reduced outer diameter in comparison to the tail section 104. Spaced apart shallow grooves 106 are formed on the tail section 104 between the portion 102 and the distal end 64.

The inner diameter of the exhaust sleeve 58 has an up hole length 108 of a constant inner diameter, a downhole length 110 of a constant inner diameter that is smaller than that of the length 108, and an intermediate transition zone 112 where the inner diameter progressively reduces from the length 108 to the length 110. The transition zone 112 is radially adjacent the portion 92 of the return tube 52. The slope of the sections 92 and 112 are substantially the same so that the diameter of the annular gap between the return tube 52 and the sleeve 58 from the distal end 64 to the shoulder 88 is substantially constant for the full length of the sleeve 58 when the tube 52 and the sleeve 58 are coaxial with each other.

The choke ring 77 is formed with a plurality of internal grooves 114, with at least one groove 114 on either side of the holes 78*b* and groove 78*a*. Respective O-rings 116 are seated in the grooves 114. These form a seal between the section 60 of the exhaust sleeve 58 and the inner surface of the choke ring 77.

With particular reference to FIG. 4 when the return exhaust assembly 50 is installed in a reverse circulation hammer H the up hole end 54 of the return tube 52 is seated on the short tube 37 and the exhaust sleeve 58 is in effect clamped in the porting sleeve 18, 19 by the bearing seat 46 which in turn acts a bearing holding the exhaust sleeve 58 substantially coaxially with the: outer case 12, the porting sleeve 18 and the piston 40. A distal end of the return tube 52 (not shown in FIG. 4) resides within the central passage of the bit 22. Thus, the return tube 52 is able to float between the bearing provided by the portion 60 and its bearing surfaces in the drill bit 22. The floating nature of the return tube 52 is assisted by the flexible coupling provided by the compression of the O-rings 70 between the portion 60 and the seat 56. The exhaust sleeve 58 does not rely on the straightness of the return tube 52 to ensure non-interference (i.e. misalignment) with the piston and is immune to, or at least to some degree isolated from, drill bit misalignment problems that may otherwise occur in prior art arrangements if the bit applies a moment to the inner tube dragging it out of alignment with the axis of the piston.

The return exhaust assembly 50 allows for tuning of the hammers power by using exhaust sleeve 58 of different length. Since the exhaust sleeve 58 is not rigidly connected to the return tube 52 it can be easily pulled off and replaced with an exhaust sleeve 58 of a different length.

Figure 5:
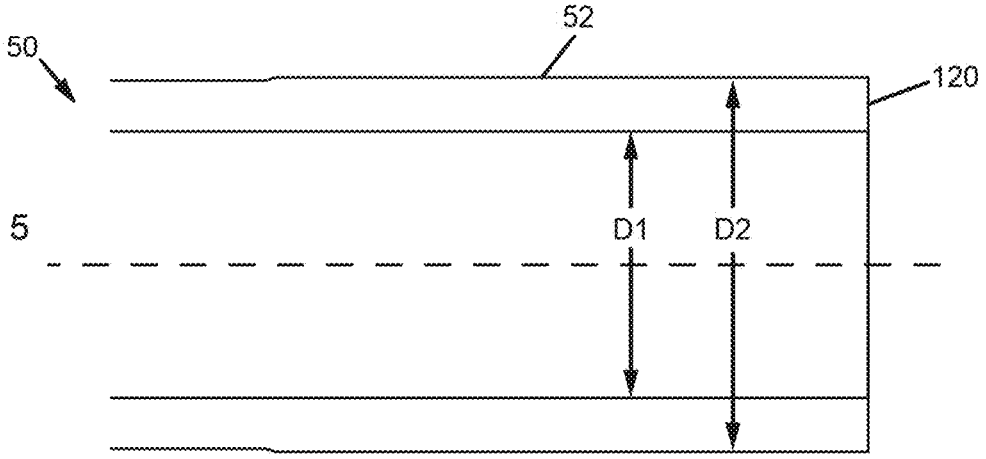
FIG. 5 is a section view of a lower end of a return tube incorporated in one embodiment of the return exhaust assembly.

FIG. 5 shows in cross-section view a second or downhole end 120 of the return tube 52 of one embodiment of the disclosed return exhaust assembly 50. The down hole end 120 resides in the central passage of the bit 22 in a reverse circulation hammer H.

The driving fluid and entrained drill cuttings when returning to the surface flow up the internal passages 34 and 33 of the bit 22 and into the return exhaust assembly 50 from the downhole end 120. The inner circumferential surface of the return tube 52 has, before wearing due to the flow of drill cuttings, a constant inner diameter D1 leading to a downhole end 120. The outer diameter of the return tube 52 is D2. In at least a new return exhaust assembly 50 or return tube 52, the downhole end 120 when viewed in the axial direction presents an annular face with an inner diameter of D1 and an outer diameter of D2.

Figure 6:
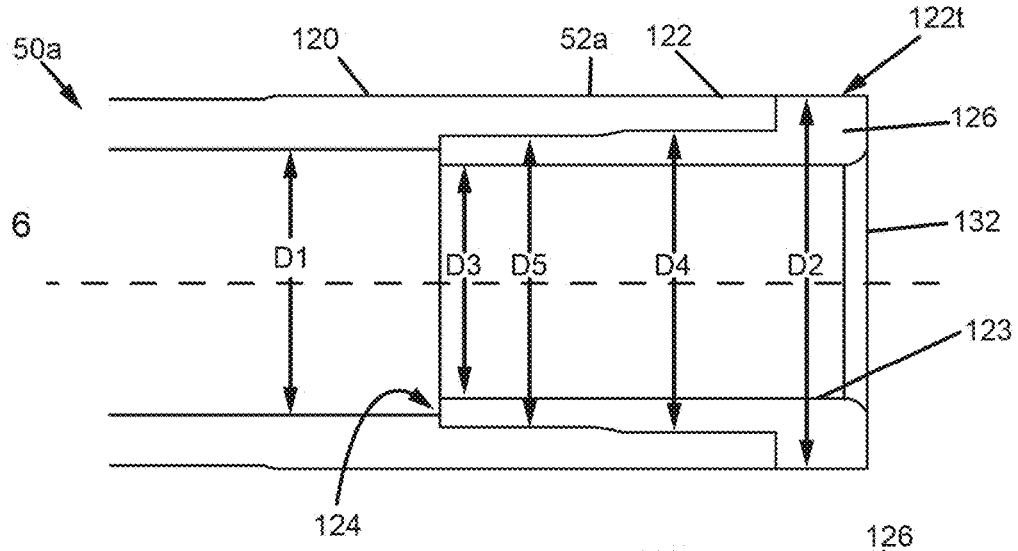
FIG. 6 is a section view of a lower end of a second embodiment of the return exhaust assembly.
Figure 7:
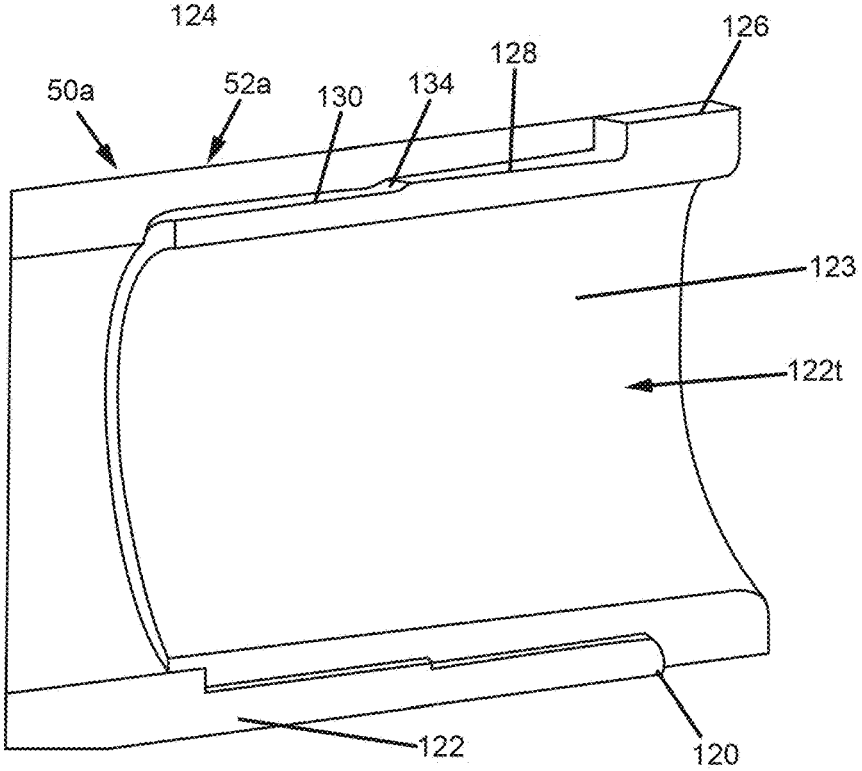
FIG. 7 is a perspective representation of the lower end of the second embodiment shown in FIG. 6.
Figure 8:
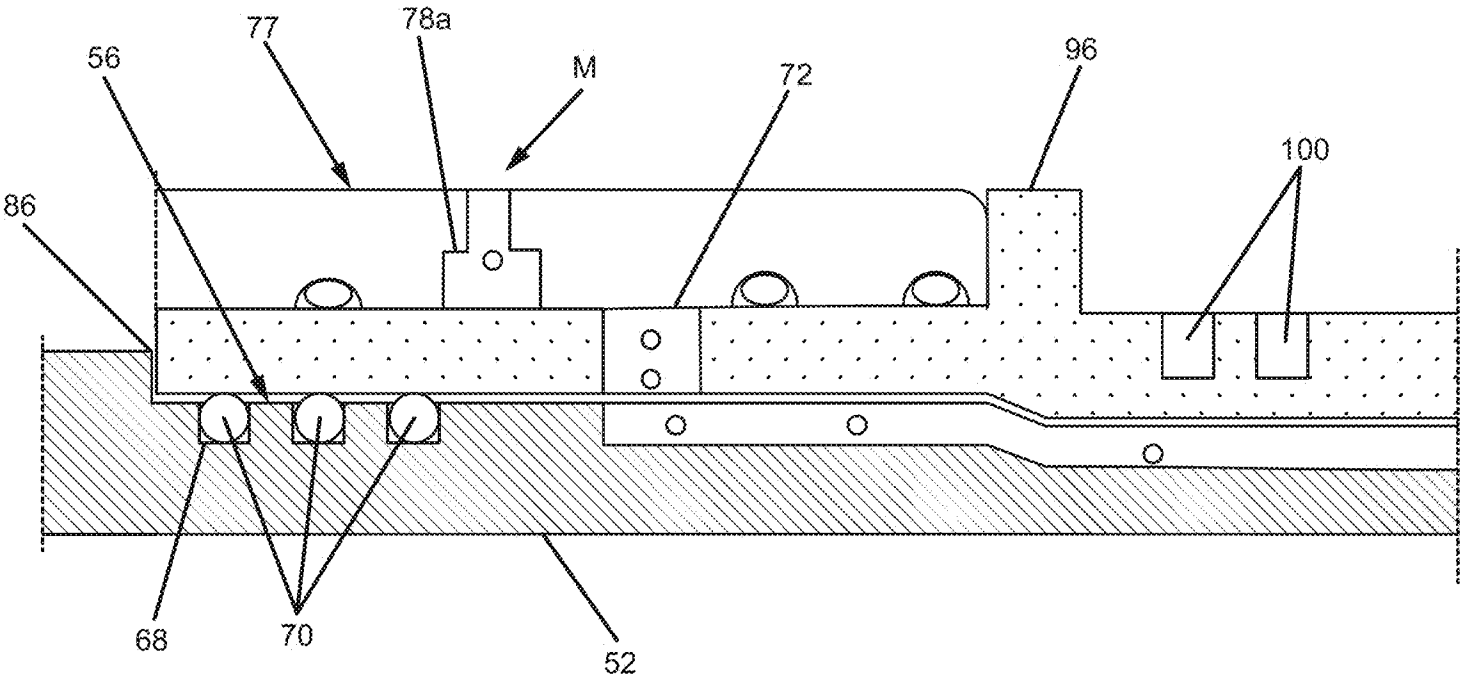
FIG. 8 is a view as shown in FIG. 3, in which the return exhaust assembly is in an orientation in which the choke ring is reversed.

A second embodiment of the return exhaust assembly 50*a* shown in FIGS. 6 and 7 in which the return tube 52 is replaced with a return tube 52*a* having a downhole end 120 with a modified downhole section 122. While the return tube 52 is formed with a constant inner diameter for its full length and of uniform material properties, the return tube 52*a* has a downhole section 122 which is formed with one or both of (a) a different inner diameter (i.e. smaller or larger) to the remainder of the return tube; and, (b) greater wear resistance than the remainder of the return tube.

The modifications to the downhole section 122 may be achieved in different ways. One way of doing this is to fit a second tube 122*t* (shown in and described with reference to FIGS. 6 and 7) to the downhole end 122. Another way is to machine, treat or work the internal surface of the down hole section 122 to achieve the same effect.

In the illustrate embodiment the second tube 122*t* can be considered to form an "insert" or wear sleeve and is made of a material having a higher wear resistance than the material from which the return tube 52*a* is made. For example, the second tube 122*t* may be made of a carbide material whereas the return tube 52*a* is made from steel. Thus, the wear resistance of the downhole section 122 is improved over the return tube 52.

The second tube 122*t* forms a contact surface of the return exhaust assembly 50*a* for material flowing in a direction from the downhole end 120 toward an up hole end of the return exhaust assembly 50*a*. The second tube 122*t* (or more broadly the downhole section 122) therefore protects the downhole end 120 from wear.

In the absence of the modified downhole section 122/second tube 122*t* the flow of material up the inner tube of a reverse circulation hammer causes wear of the downhole end creating a funnel like structure due to the wearing away of the inner bottom end surface of the inner tube at its downhole end. The degree of wear reduces in the up hole direction so that the inner diameter of the inner tube is greatest at the downhole end and progressively reduces in a direction toward the up hole end, i.e. creating a taper in the wall thickness of the return tube 52.

When drilling in soft materials such as clay this change of shape of the inner circumferential surface results in the creation of compression forces as material which spreads across the greatest inner diameter at the downhole end is compressed into the progressively narrower inner diameter moving in the up hole direction. This in turn increases the drag of the material on the surface of the inner tube and for soft material, such as clay, can result in blocking of the return tube 52*a* and the corresponding return exhaust assembly 50.

The second tube or insert 122*t*, including of course its inner circumferential surface 123, being made of a hard material resists this wear, maintaining the constant inner diameter for the initial length of travel of material from the downhole end 120 toward the up hole end at least for a longer period than the tube 52 or corresponding prior art tube 36*a*. In this embodiment the insert 122 has a constant inner diameter D3. The diameter D3≤D1. When D3<D1 a small abrupt step 124 can be created at the up hole junction of the return tube 52*a* and the second tube 122. Therefore, there is a widening of the inner diameter from D3 to D1 from the perspective of material flowing in the up hole direction. This produces a slight pressure reduction and also a reduction of the frictional forces of the material against the inner diameter of the return exhaust assembly 50*a*.

In an alternate embodiment where D3<D1 the transition in inner dimeter in the region of the up hole junction of the return tube 52*a* and the second tube 122 may be a progressive charge rather than a stepped change. In yet another alternate embodiment the inner diameter D3 may be the same as D1. In this event the return exhaust assembly 50*a* has a constant inner diameter for a continuous length starting from the downhole end 120 to a location past the second tube moving in the uphole direction.

The second tube 122*t* in this embodiment has three sections the first being a circumferential lip 126 at the downhole end, an intermediate section 128, and a trailing section 130. The lip 126 has an outer diameter D2 and an inner edge 132 of the lip 126 is formed with a radius. The lip 126 forms an axial lower end face of the return exhaust assembly 50*a* which is presented to the material flowing up the return exhaust assembly 50*a*. Accordingly the lip 126 protects the annular face of the return tube 52*a* from wear.

The intermediate section 128 is formed with an outer diameter D4, while the trailing section 130 has an outer diameter D5 where D5<D4<D2. The change in the outer diameters from D4 to D5 forms a tapered shoulder 134 about the outer circumferential surface of the second tube 122*t*.

The return tube 52*a* is profiled at its downhole end in a manner complementary to, and to thereby seat, the outer circumferential surface of the second tube 122*t*. Additionally, in comparison to the first embodiment the length of the return tube 52*a* is reduced by the axial length of the lip 126 so that overall there is no change in the substantive length of the return exhaust assembly 50*a* in comparison to the embodiment 50. Keeping this length constant avoids the need to make any variation to the design or configuration of a reverse circulation hammer to accommodate either of the embodiments.

In this embodiment the return tube 52*a* may be considered as comprising two tubes coupled together, the first tube being the return tube 52 of the first embodiment but modified at and near its end 120 to have the profile shown in FIG. 6; and the second tube 122.

The second tube 122*t* can be retained within the return tube 52*a* by various techniques including but not limited to:

- thermal expansion of the return tube 52*a* and subsequent insertion of the second tube 122 so that the return tube 52 then contracts onto the second tube 122
- use of a bronzing material between the circumferential surfaces of the return tube 52*a* and the second tube 122*t*.
- a thread coupling between the inner circumferential surface of the return tube 52*a* and the outer circumferential surface of the second tube 122. In this instance the second tube 122 may be formed with a constant outer diameter from the up hole end of the lip 126 to the up hole end of the second tube 122. Optionally an adhesive may be applied to the threads to assist in preventing separation.

In an alternate embodiment the second tube 122*t* could be coupled in an end to end configuration. In a further alternative the second tube could be formed as a dual wall structure having two concentric circumferential walls, an inner wall which locates inside the first tube and an outer wall that locates outside the first tube. In this embodiment the second tube could be connected to the first tube at an interface between the first tube and the outer wall, by any know technique such as but not limited to: a threaded connection, bronzing, and adhesive.

From the above description it should be apparent that the second tube may be configured to form either (a) an initial annular contact surface for the material flowing in the up hole direction, (b) an initial inner circumferential contact surface for the material flowing in the up hole direction; or (c) and initial annular and an initial inner circumferential contact surface for the material flowing in the up hole direction.

For option (a) the second tube would be in the form a ring comprising the lip 126 that is coupled to the end 120 of the first tube. For option (b) the second tube would for example be in the form shown in FIGS. 6 and 7 but without the lip 126. Option (c) is provided by the second tube 126 as shown in FIGS. 6 and 7.

The construction of the return tube 52*a* can also be utilised with the prior art in the tube 36 and in particular the tube 36*a* shown in FIG. 1. That is, the performance of the prior art hammer 10 shown in FIG. 1 can be improved solely by modifying the tube 36/tube 36*a* to have the form and structure of the return tube 52*a* without incorporating the exhaust return sleeve 58. Having regard to this, and for the avoidance of any doubt, an aspect of the present disclosure provides a return (or exhaust) tube 52*a* for a reverse circulation hammer 10, H which includes a first tube 36*a*/52*a*; and a second tube 122*t*. The first tube 36*a* has first and second opposite ends 54, 120. When the tube 52*a* is installed in a reverse circulation hammer 10, H the second end 120 at the downhole end of the hammer 10, H. The second tube 122*t* is of material having a higher wear resistance than material from which the first tube 36*a*/52*a* is made and is coupled to the first tube 36*a*/52*a* at the second end 120. An inner circumferential surface 123 of the second tube 122*t* forms an initial inner contact surface for return material flowing in an up hole.

As previously mentioned the benefits and effects of the second tube 122*t* can also be achieved by modifying, treating or working the downhole section 122 of the return tube 52, instead of using the second tube 122*t*. For example, the reduction in the inner diameter achieved by the diameter D3 of the second tube 122*t*, can also be obtained by adding material to or otherwise building up the interior surface of the downhole section 122. Techniques for doing this include but are not limited to: welded build up, and metal spray. Similarly, a lip 126 can also be formed by such additive techniques. Depending on the materials used for these, wear resistance can also of course be enhanced over the base material of the tube 52. Additionally, or alternately wear resistance can be improved by other techniques such as hard surfacing, case hardening and heat treating.

In both examples of modifying the downhole section 122 (i.e. the use of the second tube 122*t* or modifying, treating, or working of the surface of the downhole section 122) the interior the diametric relationship has been described as D3≤D1. However, in yet a further embodiment it is possible for the downhole section 122 to be modified so that D3>D1. In such an embodiment is more likely that this will be achieved by working the surface of the downhole section 122 rather than fitting a second tube 122*t*, although the latter is still possible.

Any discussion of the background art throughout this specification should in no way be considered as an admission that such background art is prior art, nor that such background art is widely known or forms part of the common general knowledge in the field in Australia or worldwide.

In the claims which follow and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features of the embodiments as disclosed herein.

The invention claimed is:

1. A return exhaust assembly for a reverse circulation hammer having an outer casing, and a hammer bit, the return exhaust assembly located within the outer casing and comprising:

return tube having first and second ends and a seat at or near the first end, the second end locatable within a hammer bit of a reverse circulation hammer;

an exhaust sleeve having an up hole end and a down hole end, wherein a first portion of the exhaust sleeve near the up hole end is seated and resiliently supported on the seat and a second portion of the exhaust sleeve extends from the first portion to and includes the downhole end of the exhaust sleeve, wherein the second portion surrounds a length of the return tube to form an annular clearance between the return tube and the exhaust sleeve from the seat to the downhole end of the exhaust sleeve, wherein the annular clearance and resilient support enables a degree of axial misalignment between the return tube and the exhaust sleeve within the outer casing of the reverse circulation hammer, wherein the exhaust sleeve has one or more ports enabling fluid communication between a region outside of an outer circumferential surface of the exhaust sleeve and the annular clearance; and a choke ring having a fluid flow manifold that allows fluid to flow between an inner circumferential surface of the choke ring and an outer surface of the choke ring, the choke ring being locatable over the first portion of the exhaust sleeve in: (a) a first orientation in which the manifold registers with the ports to allow of the fluid communication; and, (b) a second orientation in which choke ring covers the ports to block the fluid communication.

2. The return exhaust assembly according to claim 1 comprising one or more resilient elements located between the seat and the first portion of the exhaust sleeve, one or more resilient elements forming a fluid seal to prevent flow of fluid across the seat.

3. The return exhaust assembly according to claim 1 wherein the seat is formed inboard of the first end of the return tube, and a shoulder is formed between the seat and the first end and wherein the shoulder forms an abutment for axial displacement of the exhaust sleeve relative to the return tube in a direction toward the first end.

4. The return exhaust assembly according to claim 1 wherein the exhaust sleeve comprises one or more spaced apart annular grooves formed in the inner circumferential surface of the first portion of the exhaust sleeve.

5. The return exhaust assembly according to claim 1 wherein the return tube comprises a downhole section having a higher wear resistance than material from which a remainder of the return tube is made and wherein an inner circumferential surface of the downhole section forms a contact surface for material flowing in a direction from the second end toward the first end.

6. The return exhaust assembly according to claim 5 wherein the downhole section is configured to form either (a) an initial annular contact surface for the material flowing in the direction, (b) an initial inner circumferential contact surface for the material flowing in the direction; or (c) and initial annular and an initial inner circumferential contact surface for the material flowing in the direction.

7. The return exhaust assembly according to claim 6 wherein the downhole section comprises a circumferential lip that forms the annular contact surface for the material flowing in the direction.

8. The return exhaust assembly according to claim 5 wherein the return tube has an inner circumferential surface of diameter D1 at a location adjacent an up hole end of the downhole section, and the downhole section has an inner circumferential surface with a diameter D3 wherein D3≤D1.

9. The return exhaust assembly according to claim 8 wherein the downhole section comprises a second tube fitted or otherwise coupled to or in the return tube.

10. The return exhaust assembly according to claim 9 wherein the second tube includes a portion located inside of the return tube.

11. The return exhaust assembly according to claim 8 wherein the downhole section is formed by: (a) adding material to the inner circumferential surface of the return tube; or (b) or treating the inner circumferential surface of the return tube; or both (a) and (b).

12. The return exhaust assembly according to claim 5 wherein the downhole section is formed by: (a) adding material to an inner circumferential surface of the return tube; or (b) or treating an inner circumferential surface of the return tube; or both (a) and (b).

13. The return exhaust assembly according to claim 1 comprising:

a second tube made of material having a higher wear resistance than material from which the return tube is made, the second tube coupled to the return tube at the second end, wherein an inner circumferential surface of the second tube forms a contact surface for material flowing in a direction from the second end toward the first end.

14. The return exhaust assembly according to claim 13 wherein the second tube is configured to form either (a) an initial annular contact surface for the material flowing in the direction, (b) an initial inner circumferential contact surface for the material flowing in the direction; or (c) and initial annular and an initial inner circumferential contact surface for the material flowing in the direction.

15. A reverse circulation hammer comprising:

an outer casing a hammer bit;

a piston;

a return exhaust assembly according to claim 1 wherein the return tube passes through the piston and the second end of the return tube is located within the hammer bit.

16. The reverse circulation hammer according to claim 15 comprising a bypass inlet formed between the return tube and the exhaust sleeve up stream of the piston, the bypass inlet providing fluid communication between a source of driving fluid for the reverse circulation hammer and the annular clearance, the annular clearance forming a bypass path arranged to bypass a portion of the driving fluid from driving the piston and toward an outlet downstream of the piston wherein the bypass portion of the driving fluid flows into a hole being formed by operation of the reverse circulation hammer.

17. The reverse circulation hammer according to claim 16 comprising an adjustment mechanism operatively associated with the bypass inlet to enable a user to vary a ratio of flow of the driving fluid provided to drive the piston and the flow of the driving fluid entering the bypass inlet.

18. A reverse circulation hammer comprising:

an outer case a hammer bit retained by the outer case, a fluid driven piston slidably retained in the outer casing and arranged to cyclically impact the hammer bit;

a short tube; and a return exhaust assembly according to claim 1 wherein the first end of the return tube receives an end of the short tube and the second end of the return tube is locatable within the hammer bit.

19. The reverse circulation hammer according to claim 18 including a seal formed between an outer surface of the short tube and an overlying inner surface of the return tube.

20. A return exhaust assembly for a reverse circulation hammer having an outer casing, and a hammer bit, the return exhaust assembly located within the outer casing and comprising:

a return tube having first and second ends and a seat at or near the first end, the second end locatable within a hammer bit of a reverse circulation hammer;

an exhaust sleeve having an up hole end and a downhole end, the exhaust sleeve resiliently supported on the return tube with an inner circumferential surface of a first portion of the exhaust sleeve being radially adjacent the seat, the exhaust sleeve having a second portion that extends to the downhole end of the exhaust sleeve;

wherein the up hole and downhole ends of the exhaust sleeve are located inboard of the first and second ends of the return tube, and an annular clearance is formed between the return tube and the exhaust sleeve from the seat to the downhole end of the exhaust sleeve, wherein the annular clearance and resilient support enables a degree of axial misalignment between the return tube and the exhaust sleeve within the outer casing of the reverse circulation hammer, wherein the exhaust sleeve has one or more ports enabling fluid communication between a region outside of an outer circumferential surface of the exhaust sleeve and the annular clearance; and a choke ring having a fluid flow manifold that allows fluid to flow between an inner circumferential surface of the choke ring and an outer surface of the choke ring, the choke ring being locatable over the first portion of the exhaust sleeve in: (a) a first orientation in which the manifold registers with the ports to allow of the fluid communication; and, (b) a second orientation in which choke ring covers the ports to block the fluid communication.

* * * * *